US006486376B2

(12) United States Patent
Wittle et al.

(10) Patent No.: US 6,486,376 B2
(45) Date of Patent: Nov. 26, 2002

(54) ELECTROCHEMICAL SYSTEM AND METHOD FOR RENDERING CONTAMINATED ELECTRICALLY CONDUCTIVE MATERIAL NONHAZARDOUS

(75) Inventors: J. Kenneth Wittle, Chester Springs, PA (US); Christy W. Bell, Berwyn, PA (US)

(73) Assignee: Electro-Petroleum, Inc., Wayne, PA (US)

( * ) Notice: Subject to any disclaimer, the term of this patent is extended or adjusted under 35 U.S.C. 154(b) by 0 days.

(21) Appl. No.: 09/736,962

(22) Filed: Dec. 14, 2000

(65) Prior Publication Data

US 2001/0031905 A1 Oct. 18, 2001

Related U.S. Application Data

(60) Provisional application No. 60/170,606, filed on Dec. 14, 1999.

(51) Int. Cl.[7] ..... C25C 1/22
(52) U.S. Cl. ..... 588/204; 204/515
(58) Field of Search ..... 588/204; 204/515

(56) References Cited

U.S. PATENT DOCUMENTS

| | | | | |
|---|---|---|---|---|
| 5,164,174 A | | 11/1992 | Banker et al. | |
| 5,222,448 A | | 6/1993 | Morgenthaler et al. | |
| 5,614,077 A | * | 3/1997 | Wittle et al. | 205/704 |
| 5,955,042 A | | 9/1999 | Barnett et al. | |
| 6,074,623 A | | 6/2000 | Vick et al. | |
| 6,123,908 A | | 9/2000 | Barnett et al. | |
| 6,190,626 B1 | | 2/2001 | Cashman | |
| 6,193,944 B1 | | 2/2001 | Barnett et al. | |
| 6,217,836 B1 | | 4/2001 | Barnett et al. | |
| 6,231,822 B1 | | 5/2001 | Barnett et al. | |

FOREIGN PATENT DOCUMENTS

| | | |
|---|---|---|
| AU | 8775356 A | 1/1988 |
| EP | 0 542 404 B1 | 1/1996 |
| WO | WO 98/30499 | 7/1998 |
| WO | WO 99/29625 | 6/1999 |
| WO | WO 00/58528 | 10/2000 |
| WO | WO 00/64809 | 11/2000 |

OTHER PUBLICATIONS

Pulvirenti, A. L. et al., "Chemical treatment of spent carbon liners used in the electrolytic production of aluminum"; Journal of Hazardous Materials, 46(1): 13–21 (1996) [Abstract].

"New treatment for spent potliner"; Metal Bulletin Monthly Supplement: 77 (1996) [Abstract].

"Comalco Perfects Potline Technology"; Metal Bulletin (7624): 9 (1991) [Abstract].

Robey, H.L. et al., "Destruction of Cyanides in Electroplating Effluents by Wet Oxidation"; Cyanide Treatability in the Aluminum Industry, Proceedings of the Workshop; Paper No. XV: 14 pgs. (May 8–9, 1995) [Abstract].

Johnson, D.O., "Destruction of Cyanides"; Cyanide Treatability in the Aluminum Industry, Proceedings of the Workshop; Paper No. XVI: 17 pgs. (May 8–9, 1985) [Abstract].

(List continued on next page.)

*Primary Examiner*—Arun S. Phasge
(74) *Attorney, Agent, or Firm*—Dann Dorfman Herrell and Skillman, P.C.

(57) ABSTRACT

An electrokinetic method is disclosed for treating an electrically conductive material including hazardous contaminants, e.g. spent pot liner (SPL), to render such material non-hazardous.

2 Claims, 2 Drawing Sheets

OTHER PUBLICATIONS

"New process for treating aluminum smelter waste"; Metall (Berlin), 50(6): 422–423 (1996) [Abstract].
"A cool way to treat spent aluminum potliner"; Chemical Engineering (International Edition); 103(3): 23(1996) [Abstract].
Singh, G. et al., "Removal of fluoride from spent pot liner leachate using ion exchange"; Water Environment Research, 71(1): 36–42 (1999) [Abstract].
Adrien, R.J. et al., "Process for treatment and recovery of spent potliner (SPL).", Light Metals: Proceedings of Sessions, TMS Annual Meeting (Warrendale, Pennsylvania), 1261–1263 (1996) [Abstract].
Blayden, L.C. et al., "Spent Potliner Leaching and Leachate Treatment"; Light Metals: Proceedings of Sessions, AIME Annual Meeting (Warrendale, Pennsylvania) (Feb. 24–26, 1987) [Abstract].

* cited by examiner

ELECTROCHEMICAL SYSTEM AND METHOD FOR RENDERING CONTAMINATED ELECTRICALLY CONDUCTIVE MATERIAL NONHAZARDOUS

CROSS REFERENCE TO RELATED APPLICATION

This application claims the benefit of U.S. Provisional patent application No. 60/170,606, filed Dec. 14, 1999.

FIELD OF THE INVENTION

The present invention relates to a system and method for removing charged species present as contaminants in electrically conductive material. More specifically, the present invention provides a system and method whereby soluble salts are electrochemically/electrokinetically separated from an electrically conductive material contaminated therewith, thus enabling the safe disposal and/or recycling of the residual electrically conductive material.

BACKGROUND OF THE INVENTION

When electrically conductive materials are utilized in harsh chemical environments, ionic species present in the environment often become incorporated in the conductive material. This is especially so when the conductive material is simultaneously exposed to elevated temperatures approaching 1000° C. For example, the Hall process for converting alumina to aluminum employs an electrolytic cell or "pot" constructed of a steel shell lined with a non-conductive insulating brick with an inner liner of conductive carbon. The cell holds a molten cryolite-alumina electrolyte. The carbon bottom of the electrolytic cell is covered by a pad of molten aluminum and functions as a cathode. The anodes are carbon structures suspended in the electrolyte. During electrolysis, alumina is reduced to aluminum at temperatures in the range of 930° C.–980° C. The aluminum thus produced is deposited on the metal pad and oxygen, which is produced at the anode, reacts with the carbon to form carbon dioxide. Over a period of several years, the pot liner becomes degraded and breaks down. This is due, in part, to migration of salts from the electrolyte bath into the pot liner, which ultimately causes it to fail. The failed pot liner material is known in the industry as spent pot liner (SPL).

SPL material contains a relatively small but significant amount of cyanide (ranging from about 0.03–0.6 weight percent), a few heavy metals and substantial amounts of sodium and fluoride salts. Fluorides may comprise up to 20 weight percent of SPL material. The cyanide results from the thermal processing used during aluminum production and the fluoride is a component of commonly used aluminum flux compounds. Recent industry estimates indicate that more than 230,000 tons of SPL material is produced each year. Because of its cyanide content and high concentration of leachable fluoride, SPL material has been listed as a hazardous waste by U.S. federal and state environmental authorities. Current federal regulations and those of many states require that SPL material be treated to remove toxic cyanide and leachable fluoride constituents before it can be placed in a landfill disposal site.

Removal of the cyanide and fluoride constituents of SPL material would improve the value of the material, changing it from a hazardous material to a useful product of commerce. For example, decontaminated SPL material may serve as a valuable carbon source, which could be comminuted and burned in a commercial boiler. Moreover, SPL material contains other valuable, recoverable material that can be recycled, including, without limitation, cryolite and aluminum.

Various approaches have been proposed for rendering SPL material non-hazardous. These have included chemical treatment, pyrolysis, oxidation and agglomeration in a fluidized bed, combustion, roasting, as well as combinations of the foregoing. Many of these processes are described in U.S. Pat. Nos. 4,927,459 and 5,683,663. For various reasons, these processes have not been shown to be entirely satisfactory, either due to the capital expense involved or the inability to meet the increasingly strict standards imposed by U.S. federal and state environmental authorities for landfill disposal.

More recently, a vitrification process has emerged as a commercially viable solution to the SPL disposal problem. However, this approach does not allow for the recovery or recycling of valuable constituents of SPL materials.

From the foregoing background, it will be appreciated that a need exists for a process for decontaminating SPL material which is effective in meeting federal and local environmental standards for disposal and enables recycling of economically valuable constituents of such materials, if desired.

SUMMARY OF THE INVENTION

In accordance with the present invention, a system and method are provided for removing charged species from contaminated electrically conductive materials. Although the present invention is particularly adapted to the removal of cyanide and fluoride salts from SPL materials, it can be implemented efficiently and cost effectively for treatment of a wide range of contaminated electrically conductive materials.

The system of the present invention comprises an anode compartment including an anode, a cathode compartment, including a cathode and a treatment zone which is in fluid communication with the anode and the cathode compartments for containing the contaminated electrically conductive material undergoing treatment. The anode compartment, cathode compartment and treatment zone are arranged so that a voltage gradient applied between the anode and the cathode produces an electrical current that flows through the material in the treatment zone. This current induces water and charged species to migrate from the material undergoing treatment toward either the anode compartment or the cathode compartment, depending upon whether the charge of the contaminant is positive or negative.

The system of the present invention may, if desired, include a pH controller for monitoring and adjusting the pH of the treated material.

The method of the present invention comprises providing an electrochemical/electrokinetic apparatus in which a sample of the contaminated electrically conductive material to be treated is deposited in the treatment zone of the above-described apparatus. A voltage gradient is then applied between the anode and the cathode of the apparatus. The voltage gradient causes an electrical current to flow between the cathode and the anode through the material to be treated. The current induces water and charged species within the material undergoing treatment to migrate either towards the anode or towards the cathode, depending upon the predominant surface charge of the material undergoing treatment and whether the ionic species constituting the contaminant are negatively or positively charged. The movement of water and charged species causes the charged species to be concentrated in certain areas of the apparatus where they can then be isolated.

The process of the invention can be used to both extract hazardous contaminants from electrically conductive materials, such as SPL materials, and to destroy them.

The residue resulting from the above-described process may be further treated to recover constituents having economic value, such as carbon, cryolite and aluminum, e.g., in the case of SPL materials. The recovered constituents can readily be recycled into usable products.

The foregoing process affords technical, economic and regulatory advantages as compared with existing and emerging processes proposed for treating SPL materials.

BRIEF DESCRIPTION OF THE DRAWINGS

The foregoing summary, as well as the following detailed description of a preferred embodiment of the present invention, will be better understood when considered in conjunction with the accompanying drawings, in which.

DETAILED DESCRIPTION OF THE PREFERRED EMBODIMENT

The present invention provides an electrochemical/electrokinetic system and method for removing soluble salts from electrically conductive material containing same. This invention is effective for removing cyanide salts and fluoride salts from SPL materials.

The system used in practicing this invention is essentially the same as that described in U.S. Pat. No. 5,614,077 of J. K. Wittle and S. Pamukcu. The entire disclosure U.S. Pat. No. 5,614,077 is incorporated by reference in the present specification as though set forth herein in full.

The invention will be described hereinbelow with reference to the electrokinetic treatment of SPL material for the removal of cyanide- and fluoride-containing contaminants. It should be understood, however, that the invention has a broader range of application with respect to the treatment of contaminated electrically conductive materials generally.

Figure 1:
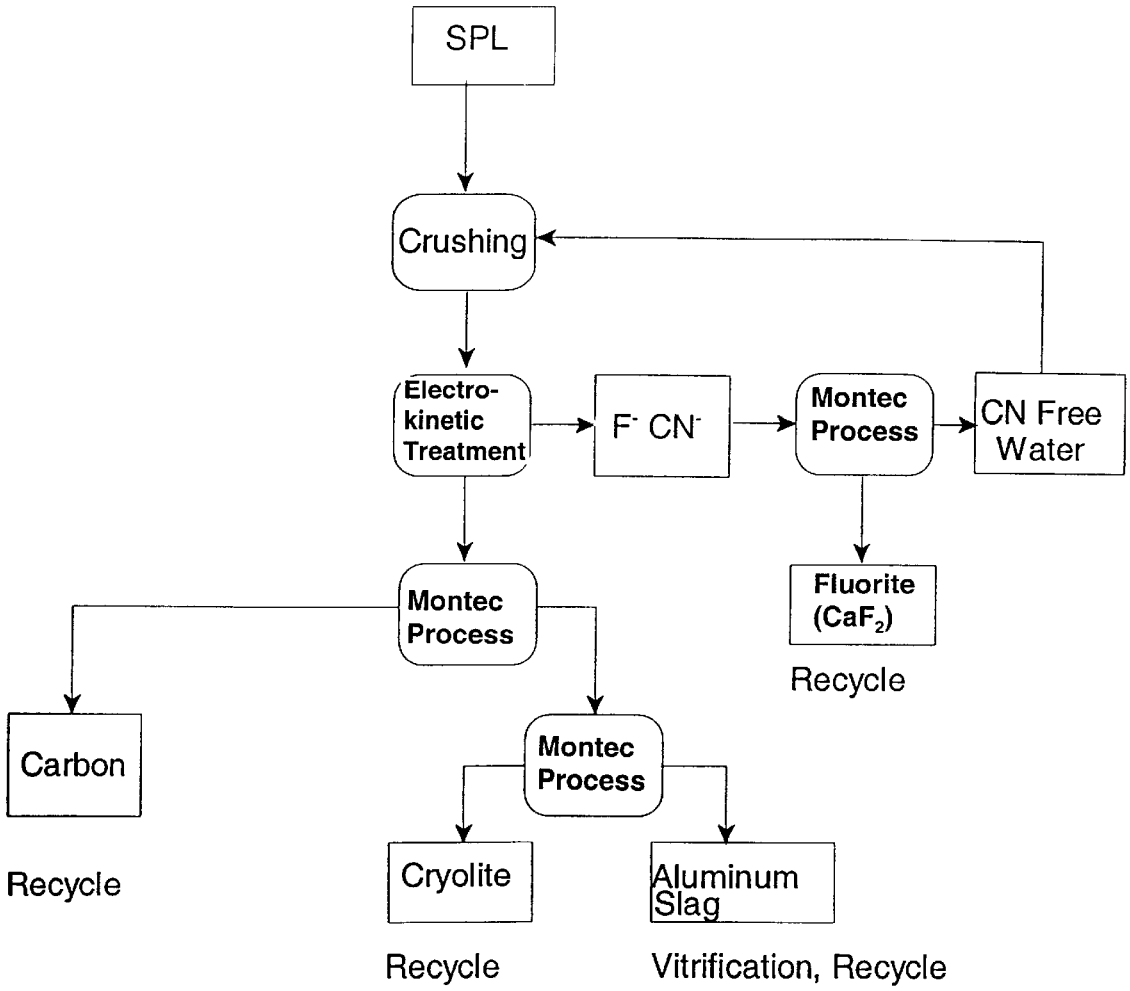
FIG. 1 is a flow diagram showing the stepwise practice of the present invention for removing cyanide ions and fluoride ions from SPL materials, as well as subsequent processing of the residue of such treatment to recover carbon, cryolite and aluminum slag, and the conversion of the removed cyanide and fluoride ions to yield fluorite and cyanide-free water which can be utilized in the process

Turning to FIG. 1 of the drawings, SPL material obtained from a failed potliner is preferably converted to powder form, for example, by crushing, grinding, pulverizing or other comminuting technique which fragmentizes the material. The comminuted material is transferred to the treatment zone of the above-described apparatus which also contains a suitable electrolyte medium. The contaminated material undergoes electrokinetic treatment for a time sufficient to substantially reduce the cyanide- and fluoride-containing ionic species present therein. The operating parameters typically involve application of a direct current (DC) potential in the range of less than 150 volts, which may be conveniently provided by a variable DC power supply. The electric current is generally less than 0.1 amps per square inch. The treatment may be carried out over a period of less than a day to obtain satisfactory results. The treatment zone can optionally include at least one auxiliary electrode for measuring voltage gradients in the treatment zone and monitoring the electrical current flowing through the treated material.

The removed fluoride and cyanide species can be subjected to further treatment to recover fluorite ($CaF_2$) and to yield cyanide ion-free water which can be utilized in the process of the invention.

The residue of the electrokinetically treated material can like wise undergo additional processing to recover products of value, such as carbon, cryolite and aluminum slag. The recovery/recycling processes identified in FIG. 2 as "Montec process" include one or more of the inventions of the following patents: U.S. Pat. No. 4,566,800, entitled "Sonic Device for Extracting Minerals from Ore"; U.S. Pat. No. 4,778,279, entitled "Sonic Agitator with Multi Phased Vibration Bars"; U.S. Pat. No. 4,780,138, entitled "Sonic Apparatus and Method for Facilitating the Extraction of Minerals from Ore in a Leachant"; U.S. Pat. No. 4,830,758, entitled "Sonic Method and Apparatus for Winning Minerals from Liquid Carriers"; U.S. Pat. No. 4,883,532, entitled "Sonic Method for Facilitating the Extraction of Minerals from Ore in a Leachant"; and U.S. Pat. No. 4,885,098, entitled "Sonic Method for Facilitating the Removal of Solid Particles from a Slurry".

The disclosures of the last-mentioned six (6) patents are incorporated by reference in the present specification as though set forth herein in full.

Figure 2:
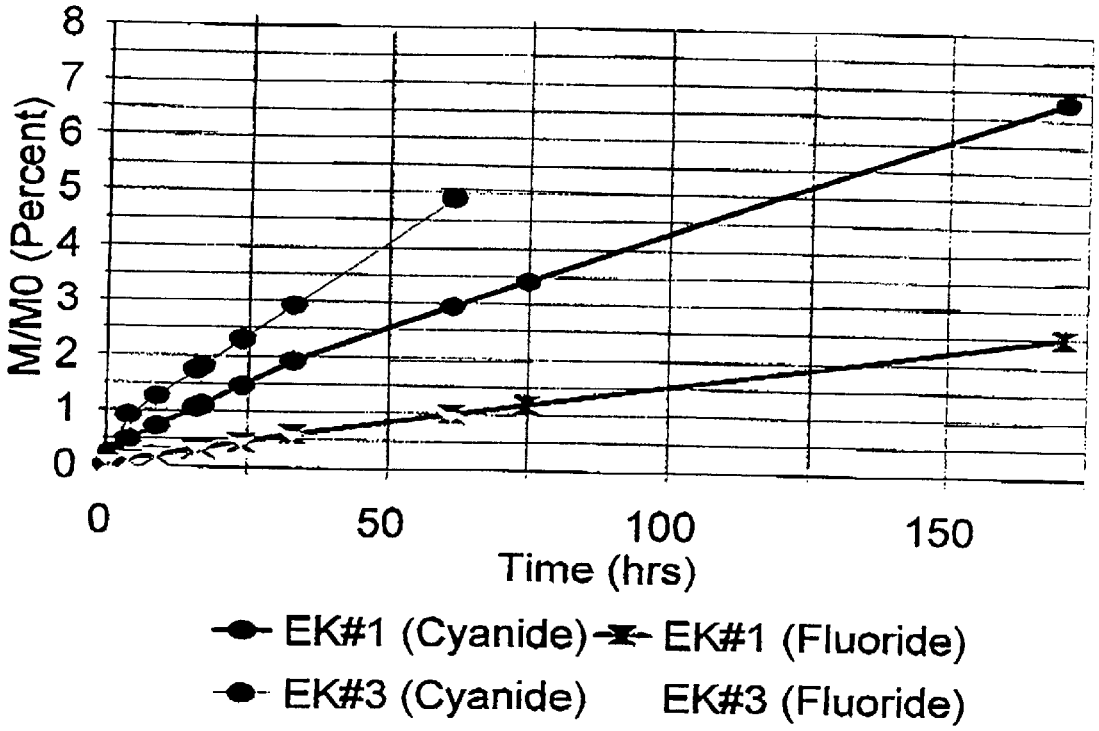
FIG. 2 is a graph presenting data obtained from experimental treatment of SPL material in accordance with the present invention.

FIG. 2 presents data recorded from two experimental runs (EK #1 and EK #3) of the process of this invention on crushed SPL material. The data show successful removal of cyanide and fluoride ions from the SPL material. Since both of these are anionic species, they were collected in the anode compartment of the apparatus. In FIG. 2, the test data represented by "EK #3 (fluoride)" substantially overlaps that recorded for "EK #1 (fluoride)".

The applied voltage in each run was 15 volts. The dry weight of the material undergoing treatment in each run was 118 grams (EK #1) and 122 grams (EK #2). In each case, the cyanide content of the material before treatment was 0.2 weight percent and the fluoride content was 9 weight percent. The values M/MO (shown on the ordinate in FIG. 2) represents the respective mass of cyanide and fluoride removed, as a percentage of the mass of those two ionic species originally present. The duration of treatment in run EK #1 was 171 hours, whereas that in EK #3 was 61.5 hours.

It will be recognized by those skilled in the art that changes or modifications may be made to the above-described embodiment without departing from the broad inventive concept of this invention. It should therefore be understood that this invention is not limited to the particular exemplified embodiment, but is intended to include all changes and modifications that are within the scope and spirit of the invention as described above.

What is claimed is:

1. A method for treating an electrically conductive solid material, including hazardous contaminants which comprise ionic species that may be either positively or negatively charged, to render said material non-hazardous, said method comprising:

a. providing an electrokinetic system comprising:

i. a plurality of electrode compartments including an anode compartment including an anode and a cathode compartment including a cathode;

ii. a treatment zone in fluid communication with said anode and said cathode compartments for containing said material;

iii. means for applying a voltage gradient across said anode and said cathode, which induces electrical current flow though said material and through said treatment zone, causing any positively charged ionic species present in said material to migrate toward said cathode compartment and any negatively charged ionic species present in said material to migrate toward said anode under the influence of said electrical current flow; and optionally, iv. a pH controller comprising a monitoring means for monitoring acidity and basicity and an adjusting means responsive to said monitoring means for adjusting the acidity and basicity of the treatment zone to promote migration of said ionic species from said treatment zone;

b. comminuting said solid material;

c. containing said comminuted solid material in said treatment zone;

d. introducing an electrolytic medium into said system;

e. applying a voltage gradient between said anode and said cathode to induce an electrical current flow through said material and cause any positively charged ionic species present in said material to migrate towards said cathode compartment and any negatively charged ionic species present in said material to migrate towards said anode compartment under the influence of said electrical current flow and; optionally, f. monitoring and adjusting the pH in said system to promote migration of said charged species from said material.

2. The method of claim 1, wherein said electrically conductive solid material is spent potliner containing cyanide and fluoride ions, the content of said cyanide and fluoride ions being reduced sufficiently to render said material non-hazardous.

* * * * *